US012227332B2

(12) United States Patent
Howe et al.

(10) Patent No.: US 12,227,332 B2
(45) Date of Patent: Feb. 18, 2025

(54) RAZOR WIRE CONTAINER WITH ACCESS OPENING

(71) Applicant: Allied Tube & Conduit Corporation, Harvey, IL (US)

(72) Inventors: William Tyler Howe, Worcester, MA (US); Carmen Samara, Homer Glen, IL (US)

(73) Assignee: Allied Tube & Conduit Corporation, Harvey, IL (US)

( * ) Notice: Subject to any disclaimer, the term of this patent is extended or adjusted under 35 U.S.C. 154(b) by 423 days.

(21) Appl. No.: 16/369,519

(22) Filed: Mar. 29, 2019

(65) Prior Publication Data

US 2019/0308771 A1 Oct. 10, 2019

Related U.S. Application Data

(60) Provisional application No. 62/653,789, filed on Apr. 6, 2018.

(51) Int. Cl.
*B65D 19/10* (2006.01)
*B65D 19/38* (2006.01)
(Continued)

(52) U.S. Cl.
CPC ..... *B65D 19/10* (2013.01); *B65D 19/385* (2013.01); *B65D 88/022* (2013.01);
(Continued)

(58) Field of Classification Search
CPC .... B65D 19/10; B65D 19/385; B65D 90/008; B65D 88/1687; E04H 17/04; E04H 17/163
(Continued)

(56) References Cited

U.S. PATENT DOCUMENTS 4,422,622 A * 12/1983 Broski, Jr. ..... E04H 17/163 119/502
5,421,557 A * 6/1995 Vise ..... E04H 17/161 256/22
(Continued)

FOREIGN PATENT DOCUMENTS

CN 107215576 A 9/2017
RU 2315159 C1 7/2010
(Continued)

OTHER PUBLICATIONS

Extended European Search Report and Written Opinion for Application No. 19167181.7, mailed on Oct. 1, 2019, 8 pages.
(Continued)

*Primary Examiner* — Robert Poon
(74) *Attorney, Agent, or Firm* — KDW FIRM PLLC

(57) ABSTRACT

A razor wire barrier or container is disclosed. In some embodiments, the razor wire container includes a plurality of walls defining an interior area for securing object(s) therein. The razor wire container may further include panels or razor wire along a frame defined by the plurality of walls, and a component receptacle extending along the frame. The razor wire container may include a movable access component to provide access to the object(s). The component receptacle is operable to receive a component of a machine for moving the frame. In some embodiments, the component receptacle is a hollow member operable to receive a forklift prong. In some embodiments, the section of razor wire includes one or more panels of razor wire.

10 Claims, 10 Drawing Sheets

(51) Int. Cl.

| | |
|---|---|
| ***B65D 88/02*** | (2006.01) |
| ***B65D 88/16*** | (2006.01) |
| ***E04H 17/16*** | (2006.01) |
| ***F41H 11/08*** | (2006.01) |
| *E01F 8/02* | (2006.01) |

(52) U.S. Cl.
CPC ..... *B65D 88/1687* (2013.01); *E04H 17/163* (2013.01); *F41H 11/08* (2013.01); *B65D 2519/00024* (2013.01); *B65D 2519/00164* (2013.01); *B65D 2519/00199* (2013.01); *B65D 2519/00273* (2013.01); *B65D 2519/00761* (2013.01); *E01F 8/025* (2013.01)

(58) Field of Classification Search
USPC ..... 220/485, 494, 495; 206/600, 383
See application file for complete search history.

(56) References Cited

U.S. PATENT DOCUMENTS

| | | | | |
|---|---|---|---|---|
| 6,138,993 | A * | 10/2000 | Mitchell, Jr. | E04H 17/163 256/25 |
| 9,580,236 | B1 | 2/2017 | Skeid | |
| 2003/0038052 | A1* | 2/2003 | Hahn | B65D 71/0096 206/526 |
| 2006/0038165 | A1* | 2/2006 | Larsen | B21F 29/00 256/32 |
| 2009/0032791 | A1 | 2/2009 | Saura Sotillos | |
| 2009/0272738 | A1 | 11/2009 | Marcel | |
| 2009/0321701 | A1 | 12/2009 | Payne | |
| 2010/0172701 | A1* | 7/2010 | Tucker | E02D 29/02 405/284 |
| 2011/0192760 | A1* | 8/2011 | Joubert | B65D 19/12 206/517 |
| 2011/0260128 | A1* | 10/2011 | Cochrane | E04H 17/16 256/19 |
| 2012/0152946 | A1* | 6/2012 | Gronholm | B65D 19/10 220/6 |

FOREIGN PATENT DOCUMENTS

| | | | |
|---|---|---|---|
| WO | 2015061277 | A1 | 4/2015 |
| WO | 2015154103 | A1 | 10/2015 |

OTHER PUBLICATIONS

Search Report and a Written Opinion from Singapore Patent Application No. 10201902928X (eight (8) sheets.

* cited by examiner

RAZOR WIRE CONTAINER WITH ACCESS OPENING

CROSS-REFERENCE TO RELATED APPLICATION

This application claims priority to U.S. Provisional Patent Application No. 62/653,789 filed Apr. 6, 2018, entitled "Razor Wire Container with Access Opening," and incorporated by reference herein in its entirety.

BACKGROUND OF THE DISCLOSURE

Field of the Disclosure

The present disclosure relates to secured containers and, more particularly, to a razor wire container with an access opening.

Discussion of Related Art

Many barriers exist for providing a deterrent to ingress into and/or egress from a secured area. One known apparatus is a barbed or razor wire fence comprised of a plurality of strands of spaced wires supported by a plurality of horizontally spaced posts. Another known apparatus is a mesh wire fence, which may also be supported by a plurality of horizontally spaced posts. Each apparatus may also be topped by a plurality of strands of barbed/razor wire inclined at an angle towards the outside of the secured area and, in some instances, a plurality of strands of barbed/razor wire inclined at an angle towards the inside of the secured area. Such angularly oriented strands of barbed/razor wire are provided for preventing a human from climbing the security fence and then climbing upwardly over the top of the security fence. In other known apparatuses, one or more layers of concertina razor wire may be coupled to a fence.

SUMMARY OF THE DISCLOSURE

In one or more embodiments, a razor wire container may include a frame including a plurality of walls defining an interior area, the plurality of walls each including a section of razor wire. The razor wire container may further include a movable access component to provide access through the plurality of walls, and a component receptacle extending along the frame, the component receptacle operable to receive a component for moving the frame.

In one or more embodiments, a razor wire container may include a frame including a plurality of walls defining an enclosed interior area, the plurality of walls each including a section of razor wire, and an access component coupled to one or more of the plurality of walls, wherein the access component is movable to provide access to the enclosed interior area, wherein the access component comprises one or more sections of razor wire extending across a panel frame.

In one or more embodiments, a container may include a frame including a plurality of walls and a floor defining an enclosed interior area, the plurality of walls each including a section of razor wire, and an access component coupled to one or more of the plurality of walls, wherein the access component is movable to provide access to the enclosed interior area, wherein the access component comprises one or more sections of razor wire extending across a panel frame.

BRIEF DESCRIPTION OF THE DRAWINGS

The accompanying drawings illustrate exemplary approaches of the disclosure, including the practical application of the principles thereof, and in which.

Figure 1:
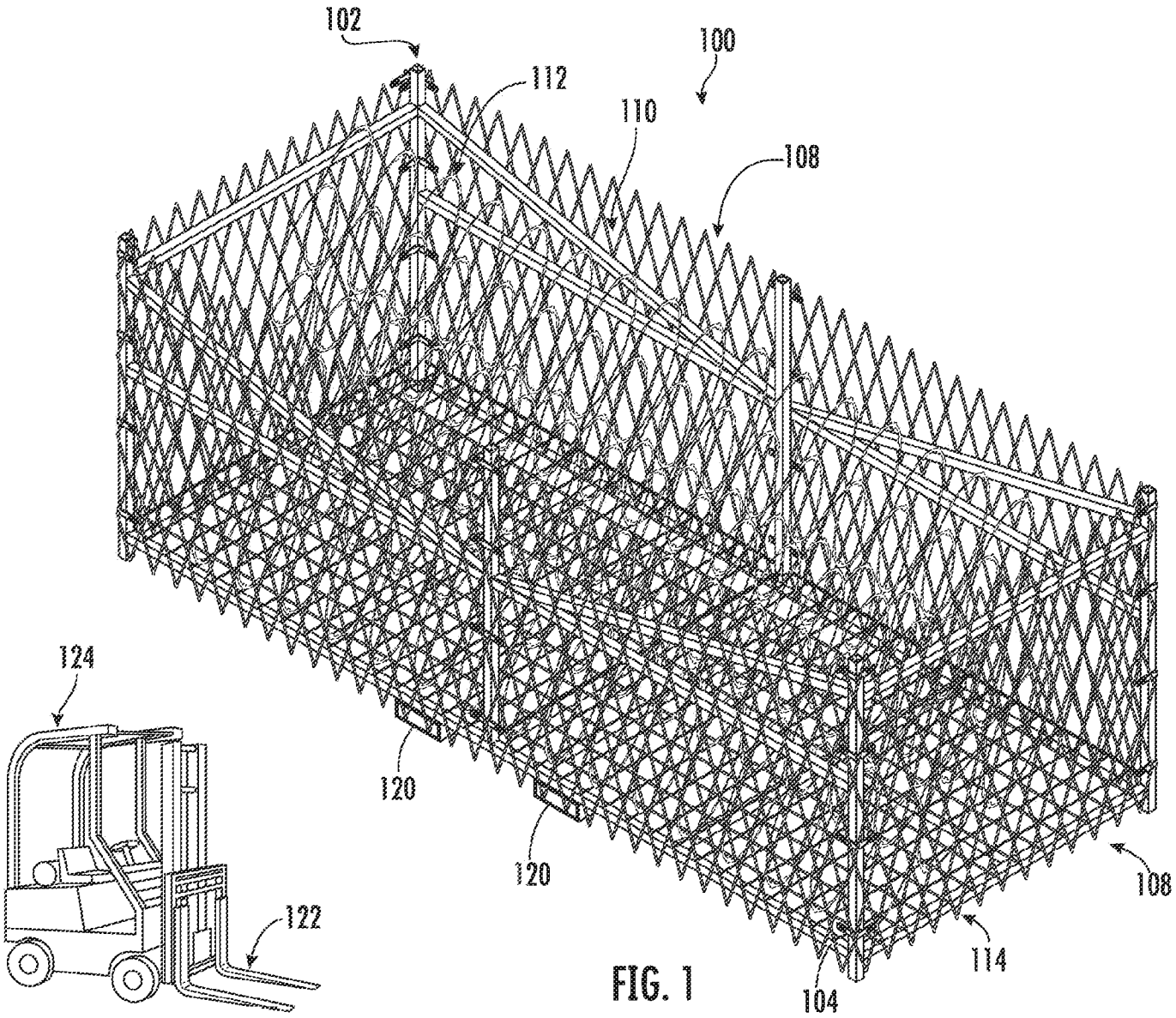
FIG. 1 is a perspective view of a razor wire barrier according to exemplary approaches of the disclosure.

The drawings are not necessarily to scale. The drawings are merely representations, not intended to portray specific parameters of the disclosure. Furthermore, the drawings are intended to depict exemplary embodiments of the disclosure, and therefore is not considered as limiting in scope.

Furthermore, certain elements in some of the figures may be omitted, or illustrated not-to-scale, for illustrative clarity. The cross-sectional views may be in the form of "slices", or "near-sighted" cross-sectional views, omitting certain background lines otherwise visible in a "true" cross-sectional view, for illustrative clarity. Furthermore, for clarity, some reference numbers may be omitted in certain drawings.

DETAILED DESCRIPTION

The present disclosure will now proceed with reference to the accompanying drawings, in which various approaches are shown. It will be appreciated, however, that the disclosed barrier may be embodied in many different forms and should not be construed as limited to the approaches set forth herein. Rather, these approaches are provided so that this disclosure will be thorough and complete, and will fully convey the scope of the disclosure to those skilled in the art. In the drawings, like numbers refer to like elements throughout.

As will be further described herein, a razor wire barrier or container is disclosed. In some embodiments, the razor wire container includes a plurality of walls defining an interior area for securing object(s) therein. The razor wire container may further include panels or razor wire along a frame defined by the plurality of walls, and a component receptacle extending along the frame. The razor wire container may include a movable access component to provide access to the object(s). The component receptacle is operable to receive a component of a machine for moving the frame. In some embodiments, the component receptacle is a hollow member operable to receive a forklift prong. In some embodiments, the section of razor wire includes one or more panels of razor wire.

Figure 2:
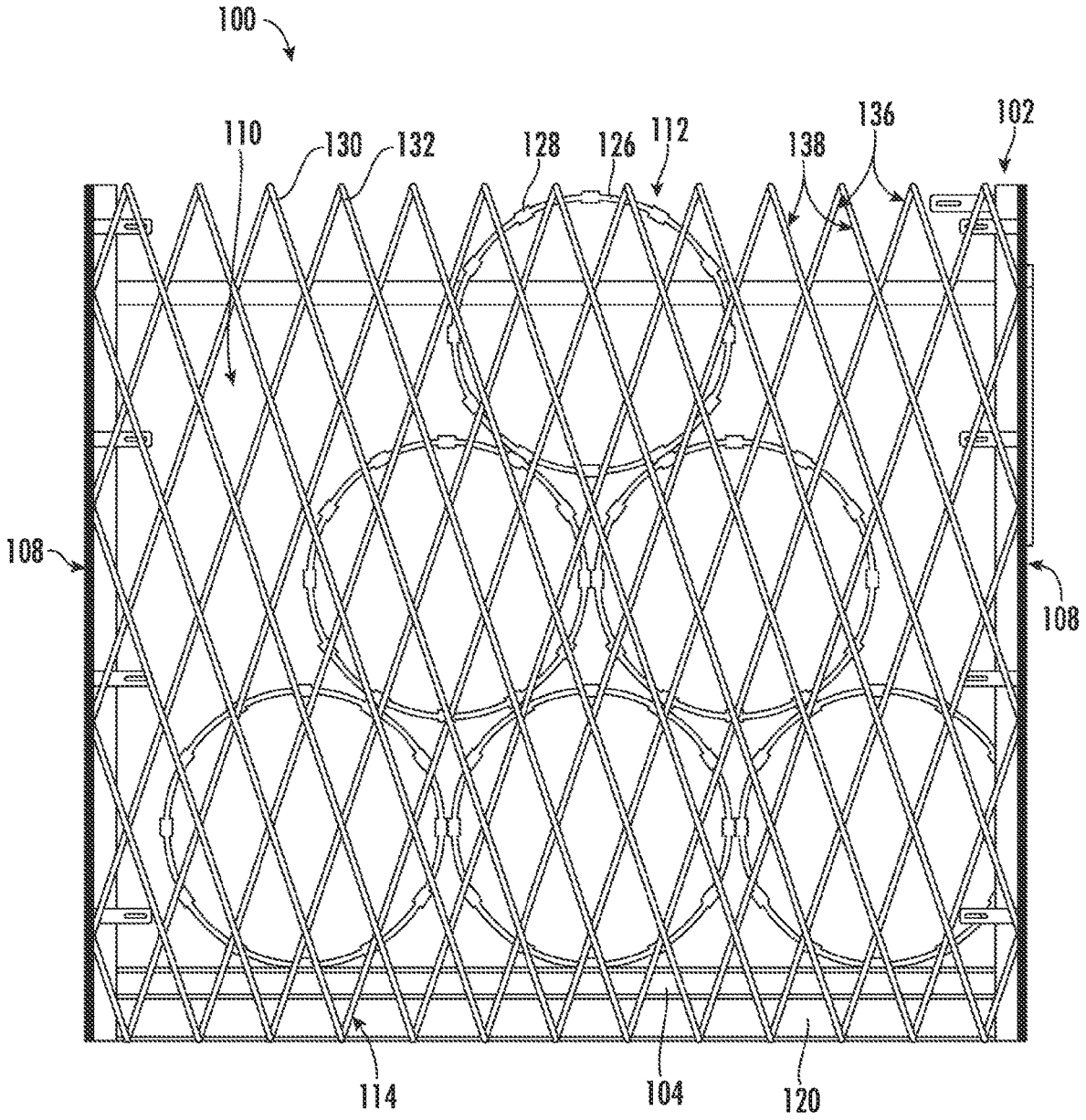
FIG. 2 is an end view of the razor wire barrier of FIG. 1 according to exemplary approaches of the disclosure.

Referring now to FIGS. 1-2, a razor wire barrier (hereinafter "barrier") 100 will be described in greater detail. As shown, the barrier 100 may include a frame 102 having a floor 104 and a plurality of side walls 108 extending from the floor 104. Together, the floor 104 and the plurality of side walls 108 may define an interior area 110, which may be open at the top. The barrier 100 may include a first section of razor wire 112, such as one or more coils of concertina or helical razor wire, within the interior area 110. The barrier 100 may further include a second section of razor wire 114, such as one or more planar sections of razor wire, extending along each of the plurality of side walls 108. The barrier 100 may further include one or more component receptacles 120 operable to receive a component 122 (e.g., a fork prong) of a machine, such as a forklift 124. During use, the component receptacles 120 may be engaged by the forklift 124 to move the barrier 100 into and out of position relative to a physical access point (not shown), such as a gate, opening, doorway, etc.

As best shown in FIG. 2, in some embodiments, the first section of razor wire 112 (interchangeably referred to as razor ribbon, ribbon tape, or barbed tape), may include a central support section 126 and a set of barb clusters 128 extending from the central support section 126. The first section of razor wire 112 may be arranged in a concertina pattern whereby adjacent loops of helical coils are attached to one another at specified points on the circumference, as shown. In other embodiments, an elongated strip of metal corresponding to the central support section 126 may be bent slightly along its longitudinal axis in such a way that the strip substantially forms a helix. The concertina and helical structures are effective for preventing intrusions across the barrier 100 because barbs at the top of the first section of razor wire 112 extend directly toward a would-be intruder. In some non-limiting embodiments, each barb cluster may include four barbs, with a pair of barbs extending from each side of the central support section 126.

The non-limiting embodiment shown in FIGS. 1-2 may include six (6) coils of concertina razor wire arranged as a pyramid, the coils substantially covering an area of the floor 104. However, it'll be appreciated that a fewer or greater number of coils are possible within the scope of the present disclosure. A major axis of the circle or ellipse defined by each coil loop of the first section of razor wire 112 may extend in a generally parallel relationship to a plane defined by the floor 104. In some alternative embodiments, each coil loop of the first section of razor wire 112 may overlap an adjacent coil.

In some embodiments, the second section of razor wire 114 may include one or more panels of razor wire. As best shown in FIG. 2, the second section of razor wire 114 may similarly include a central support section 130 and a set of barb clusters 132 extending from the central support section 130. In some embodiments, the set of barb clusters 132 may be relatively smaller and spaced closer together than the barb clusters 128 of the first section of razor wire 112. Embodiments herein are not limited in this context, however. The second section of razor wire 114 may be secured to the frame 102 by any means.

As further shown, the second section of razor wire 114 may be arranged as a mesh in which a first plurality of wire strands 136 is positioned across a second plurality of wire strands 138. In some embodiments, the first and second plurality of wire strands 136 and 138 may be interwoven. In other embodiments, the first plurality of wire strands 136 may not be interwoven with the second plurality of wire strands 138 and, instead, may be positioned directly adjacent one another. In yet other embodiments, the first and second plurality of wire strands 136 and 138 are integrally formed. Although shown in a crisscross diamond configuration, it'll be appreciated that the first and second plurality of wire strands 136 and 138 may also be oriented perpendicular to one another in other embodiments.

Figure 3:
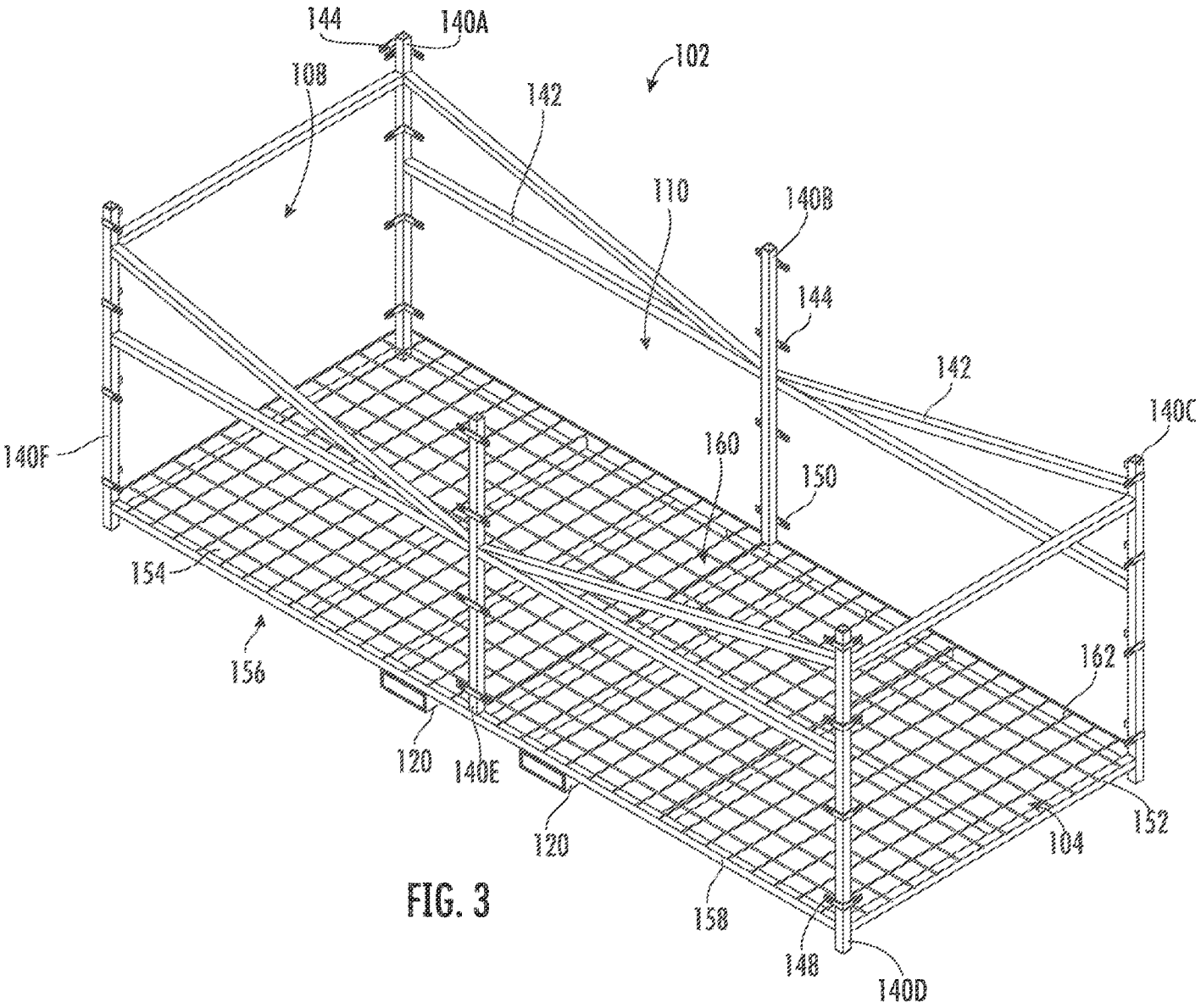
FIG. 3 is a perspective view of a frame of the razor wire barrier of FIG. 1 according to exemplary approaches of the disclosure.
Figure 4:
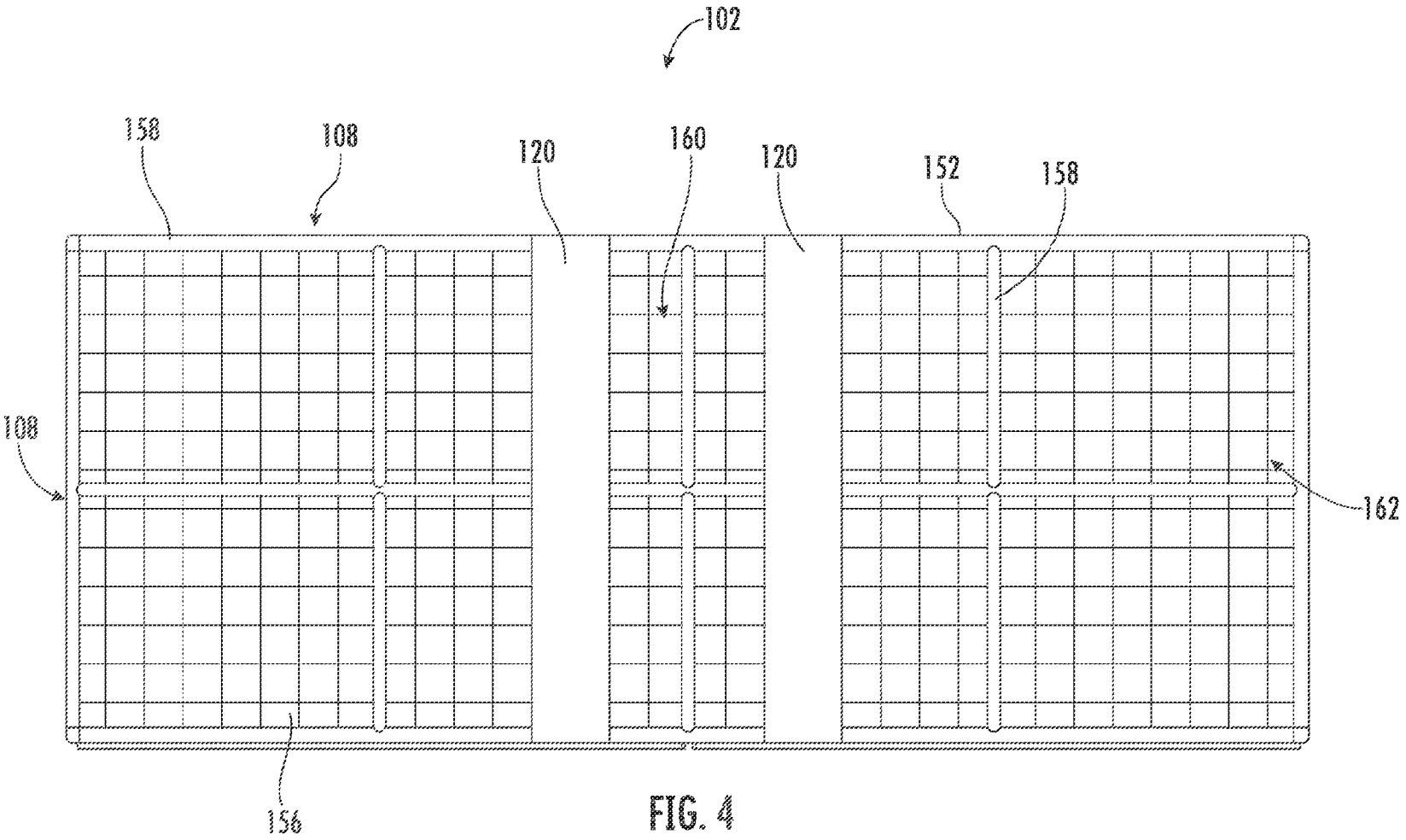
FIG. 4 is a bottom view of the frame of FIG. 3 according to exemplary approaches of the disclosure.

Referring now to FIGS. 3-4 the frame 102 of the barrier of FIGS. 1-2 according to embodiments of the present disclosure will be described in greater detail. As shown, the frame 102 may generally take on a rectangular or cuboid cage shape, including a plurality of perimeter posts 140A-F extending from the floor 104. Embodiments herein are not limited to any particular shape, however. For example, in other embodiments, the frame 102 may take on a square shape or a semicircular shape. As shown, each of the plurality of perimeter posts 140A-F may extend perpendicularly from the floor 104, thus defining each of the plurality of side walls 108. Extending between the plurality of perimeter posts 140A-F may be one or more cross posts 142. In some embodiments, one or more cross posts 142 may extend perpendicular to the perimeter posts 140A-F, and parallel to the floor 104. One or more other cross posts 142 are diagonally oriented with respect to the perimeter posts 140A-F and the floor 104 to provide stability to the perimeter posts 140A-F and therefore the side walls 108. In some embodiments, the plurality of posts 140A-F and the cross posts 142 are galvanized or stainless steel.

In a non-limiting embodiment, a height of each of the plurality of posts 140A-F, in an installed configuration, is preferably substantially in excess of the height of an average human. Furthermore, each of perimeter posts 140A, 140C, 140D, and 140F may extend below the floor 104, thus making contact with a ground surface. The floor 104 of the frame 102 may be raised from the ground surface to permit sufficient clearance for the component receptacles 120. In some embodiments, each of the perimeter posts 140B and 140E may not extend below the floor 104 so as to minimize potential interference between the fork of the forklift and the component receptacles 120.

As further shown, each of the plurality of perimeter posts 140A-F may include a fastener 144 coupled thereto. Although not limited to any particular shape or configuration, the fasteners 144 coupled to each of perimeter posts 140A, 140C, 140D, and 140F may each be an L-shaped bracket including a pair of openings 148 operable to receive a second fastener therethrough, such as a loop, clip, or hog ring-type fastener. The second fastener may couple together the second section of razor wire 114 and the L-shaped bracket. As further shown, the fasteners 144 coupled to each of the perimeter posts 140B and 140E may be a straight bracket, also including a pair of openings 150 for receiving the second fastener therethrough. In some embodiments, the first section of razor wire 112 may also be coupled to one or more of the perimeter posts 140A-F via the one or more fasteners 144.

The floor 104 of the frame 102 may include an outer perimeter 152, a first side 154, and a second side 156 opposite the first side 154. In some embodiments, the first side 154 of the floor 104 faces the interior area 110, while the second side 156 faces away from the interior area 110. As arranged, the first section of razor wire 112 (FIGS. 1-2) may be disposed directly atop the first side 154 of the floor 104. In some embodiments, the floor 104 includes a plurality of structural elements 158 for providing strength and rigidity to the floor 104. Although not limited to any particular shape or arrangement, the structural elements 158 may extend around the outer perimeter 152, as well as through a central area 160 of the floor 104, for example, in a windowpane pattern. In some embodiments, the structural elements 158 may be galvanized or stainless steel.

The floor 104 may further include a wire mesh fencing 162 extending between the structural elements 158. In some embodiments, the wire mesh fencing 162 may be coupled or welded to the structural elements 158 to provide a secure connection therebetween. The wire mesh fencing 162 may be a woven wire mesh having a square pattern, which is supported by the structural elements 158. The wire mesh fencing 162 is preferably formed from a strong and durable material, such as steel. The wire mesh fencing 162 may be sized and arranged so as to substantially cover the area of the floor 104 defined by the outer perimeter 152. In some embodiments, the first section of razor wire 112 may be coupled to the wire mesh fencing 162 and or the structural elements 158 using any variety of fasteners, ties, clasps, etc.

As better shown in FIG. 4, extending along the second side 156 of the floor 104 is the pair of component receptacles 120 in the central area 160 thereof. Each of the component receptacles 120 may be a hollow member extending parallel to one another. In some embodiments, the component receptacles 120 may extend substantially between opposite side walls 108 to enable access by the forklift from either side. The component receptacles 120 are preferably formed from a strong and durable material, such as steel, and may be coupled to the structural elements 158 of the floor 104, for example, by bolts or via welding. Although not limited to any particular shape or configuration, the component receptacles 120 are preferably dimensioned so as to accept a fork of a forklift therein. During use, the component receptacles 120 allow the barrier 100 to be lifted off of the ground surface and moved by the forklift when access through the physical access point is desired.

Figure 5:
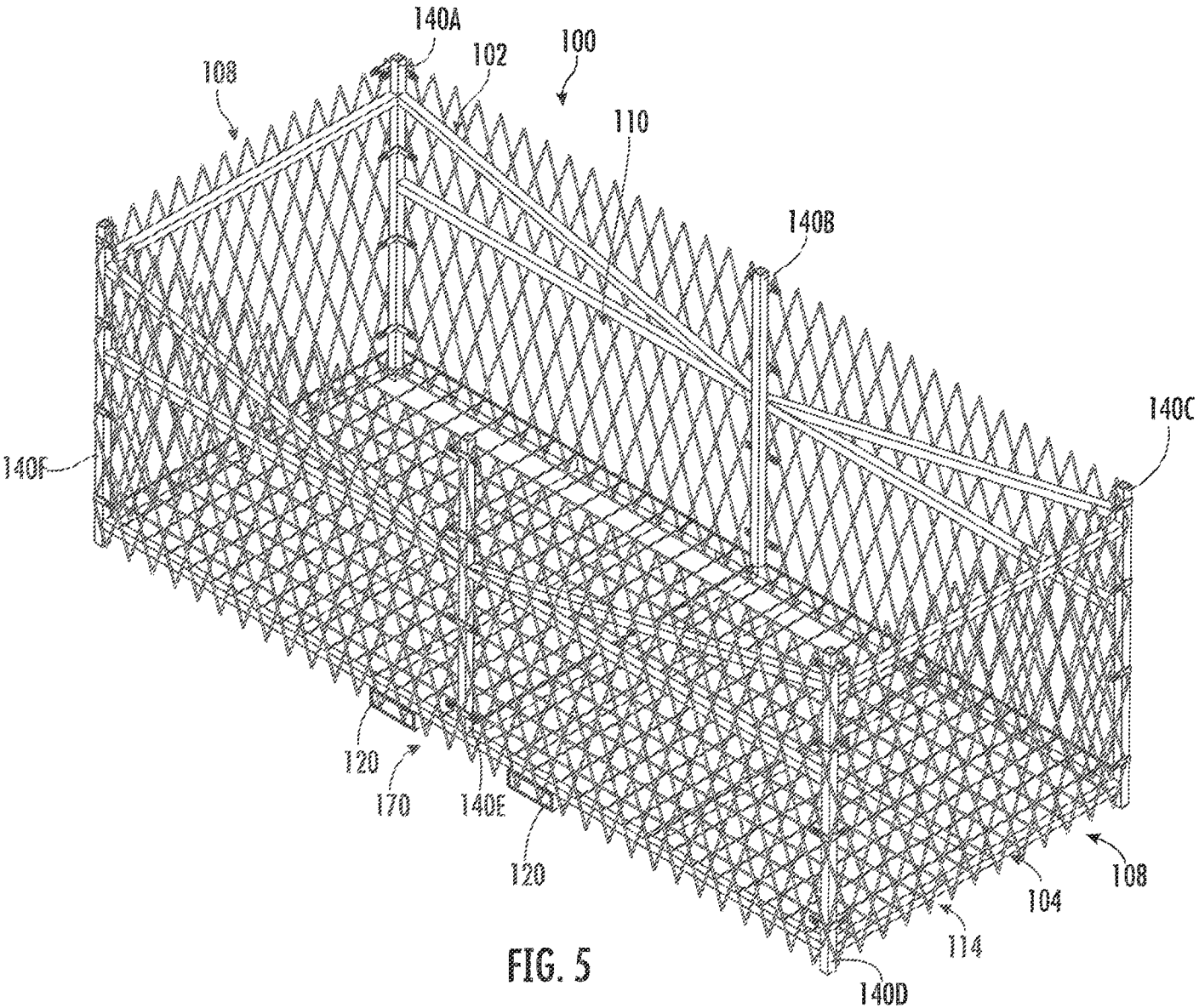
FIG. 5 is an alternative perspective view of the razor wire barrier of FIG. 1 according to exemplary approaches of the disclosure.

Turning now to FIG. 5, the barrier 100 according to embodiments of the present disclosure will be described in greater detail. As depicted, the first section of razor wire has been removed for ease of viewing the other components of the barrier 100. The barrier 100 may have a generally cuboid shape without an upper face. That is, no component may be provided over the interior area 110 to minimize the number of climbing points for the barrier 100. In the event a person was to scale one of the side walls 108, he/she would end up in the interior area 110.

In this embodiment, each of the side walls 108 is one or more panels of razor wire. For example, the second section of razor wire 114 may include a panel of razor wire extending between and coupled to two or more directly adjacent perimeter posts of the plurality of perimeter posts 140A-F. In other embodiments, one razor panel may span an entire side wall 108, e.g., extending across two (2) or three (3) perimeter posts. In other embodiments, one or more of the side walls 108 may be wire fencing, such as chain-link fencing. As is known, chain-link fencing (also known as wire netting, wire-mesh fence, chain-wire fence, cyclone fence, hurricane fence, or diamond-mesh fence) is a type of woven fence usually made from steel wire. The wires may run vertically, and are bent into a zig-zag pattern so that each "zig" hooks with the wire immediately on one side and each "zag" with the wire immediately on the other. This forms the characteristic diamond pattern seen in this type of fence. The chain-link fencing may take the place of the second section of razor wire 114, or the second section of razor wire 114 may be coupled to the chain-link fence, for example, along an outer facing side thereof. In the case one or more of the side walls 108 includes both chain-link fencing and razor wire, the two may be integrally coupled or joined together by any variety of fasteners, ties, clasps, etc.

As stated above, each of perimeter posts 140A, 140C, 140D, and 140F may extend below the floor 104, thus resting on the ground surface. The floor 104 of the frame 102 may be raised from the ground surface to permit sufficient clearance for the component receptacles 120. To minimize potential points of intrusion, however, the second section of razor wire 114 may also extend down substantially to the ground surface. The second section of razor wire 114 may include a mesh cutout 170 in an area proximate the component receptacles 120 to permit access thereto by the forklift.

Figure 6:
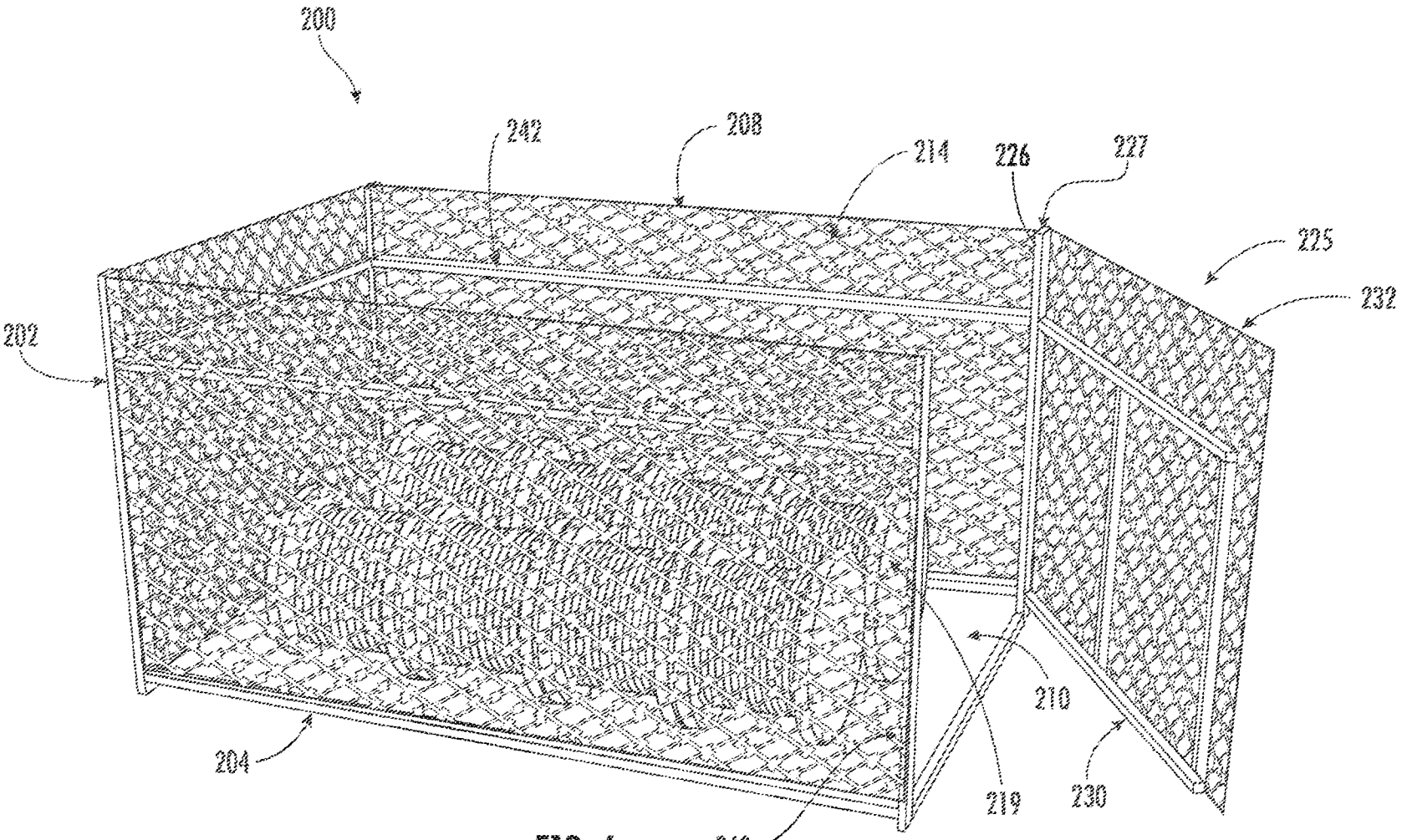
FIG. 6 is a perspective view of a razor wire container according to exemplary approaches of the disclosure.

Referring now to FIG. 6, a razor wire barrier container (hereinafter "container") 200 will be described in greater detail. The container 200 may include any of the features previously described in relation to the barrier 100 above and, as such, may not be described hereinafter in full detail for the sake of brevity. As shown, the container 200 may include a frame 202 including a plurality of side walls 208, which may extend from a floor or floor perimeter 204. Together, the floor perimeter 204 and the plurality of side walls 208 may define an interior area 210, which may be open or closed at the top. The container 200 may include a section of razor wire 214, such as one or more planar sections of razor wire, extending along each of the plurality of side walls 208. The container 200 may further include one or more component receptacles 220 (FIG. 7) operable to receive a component 122 (FIG. 1) (e.g., a fork prong) of a machine, such as a forklift 124. During use, the component receptacles 220 may be engaged by the forklift 124 to move the container 200 to a desired position.

The container 200 may be used to secure any variety of objects 219 therein. In the non-limiting embodiment shown, the objects 219 may be wound tubing or wiring, such as copper wiring. Of course, virtually any object may be secured by the container 200. To provide access to the objects 219, the container 200 may include one or more access components or panels 225. As shown, the access panel 225 may be one of the plurality of sidewalls 208, such as an end wall. The access panel 225 may be a door, which is pivotably coupled with one or more members of the frame 202. For example, as shown, the access panel 225 may be coupled to, and rotate about, a panel support 226. In some embodiments, the access panel 225 may include a panel frame 230 coupled to a section of razor wire 232. In other embodiments, the access panel 225 may span only a portion of a sidewall 208. In yet various other embodiments, the access panel 225 is pivotably coupled by a hinge or other coupling device 227, which allows the access panel 225 to swing open. Embodiments herein are not limited in this context, however. For example, the access panel 225 may slide or shift upwards away from floor perimeter 204.

In some embodiments, the section of razor wire 214 and/or the section of razor wire 232 may include one or more panels of razor wire. Although not shown in detail, each individual wire of the section of razor wire 214 and the section of razor wire 232 may include a central support section and a set of barb clusters extending from the central support section. Embodiments herein are not limited in this context, however. The section of razor wire 214 may be secured to the frame 202 by virtually any means.

As further shown, the section of razor wire 214 may be arranged as a mesh in which a first plurality of wire strands is positioned across a second plurality of wire strands. In some embodiments, the first and second plurality of wire strands may be interwoven. In other embodiments, the first plurality of wire strands may not be interwoven with the second plurality of wire strands and, instead, may be positioned directly adjacent one another. In yet other embodiments, the first and second plurality of wire strands are integrally formed. Although shown in a crisscross diamond configuration, it'll be appreciated that the first and second plurality of wire strands may also be oriented perpendicular to one another in other embodiments.

The frame 202 of the container 200 of FIG. 6 may generally take on a rectangular or cuboid cage shape, including a plurality of perimeter posts 240 extending from the floor perimeter 204. Embodiments herein are not limited to any particular shape, however. For example, in other embodiments, the frame 202 may take on a square shape or a semicircular shape. As shown, each of the plurality of perimeter posts 240 may extend perpendicularly from the floor perimeter 204, thus defining each of the plurality of side walls 208. Extending between the plurality of perimeter posts 240 may be one or more cross posts 242. In some embodiments, one or more cross posts 242 may extend perpendicular, or substantially perpendicular, to the perimeter posts 240. The cross posts 242 may therefore be parallel to the plane defined by the floor perimeter 204. In some embodiments, the plurality of posts 240 and the cross posts 242 are galvanized or stainless steel. Each of perimeter posts 240 may extend below the floor perimeter 204, thus making contact with a ground surface. The floor perimeter 204 of the frame 202 may be raised from the ground surface to permit sufficient clearance for the component receptacles 220. In some embodiments, one or more of the perimeter posts 240 may not extend below the floor perimeter 204 so as to provide clearance for the fork of the forklift and the component receptacles 220.

The floor perimeter 204 of the frame 202 may define an outer perimeter. In some embodiments, the floor perimeter 204 includes a plurality of structural elements (FIG. 7) extending between the outer perimeter for providing strength and rigidity to the floor. Although not limited to any particular shape or arrangement, the structural elements may extend to the outer perimeter 252, as well as through a central area of the floor, for example, in a windowpane pattern (e.g., similar to the floor shown in FIGS. 1-5 above). In some embodiments, the structural elements may be galvanized or stainless steel.

Figure 7:
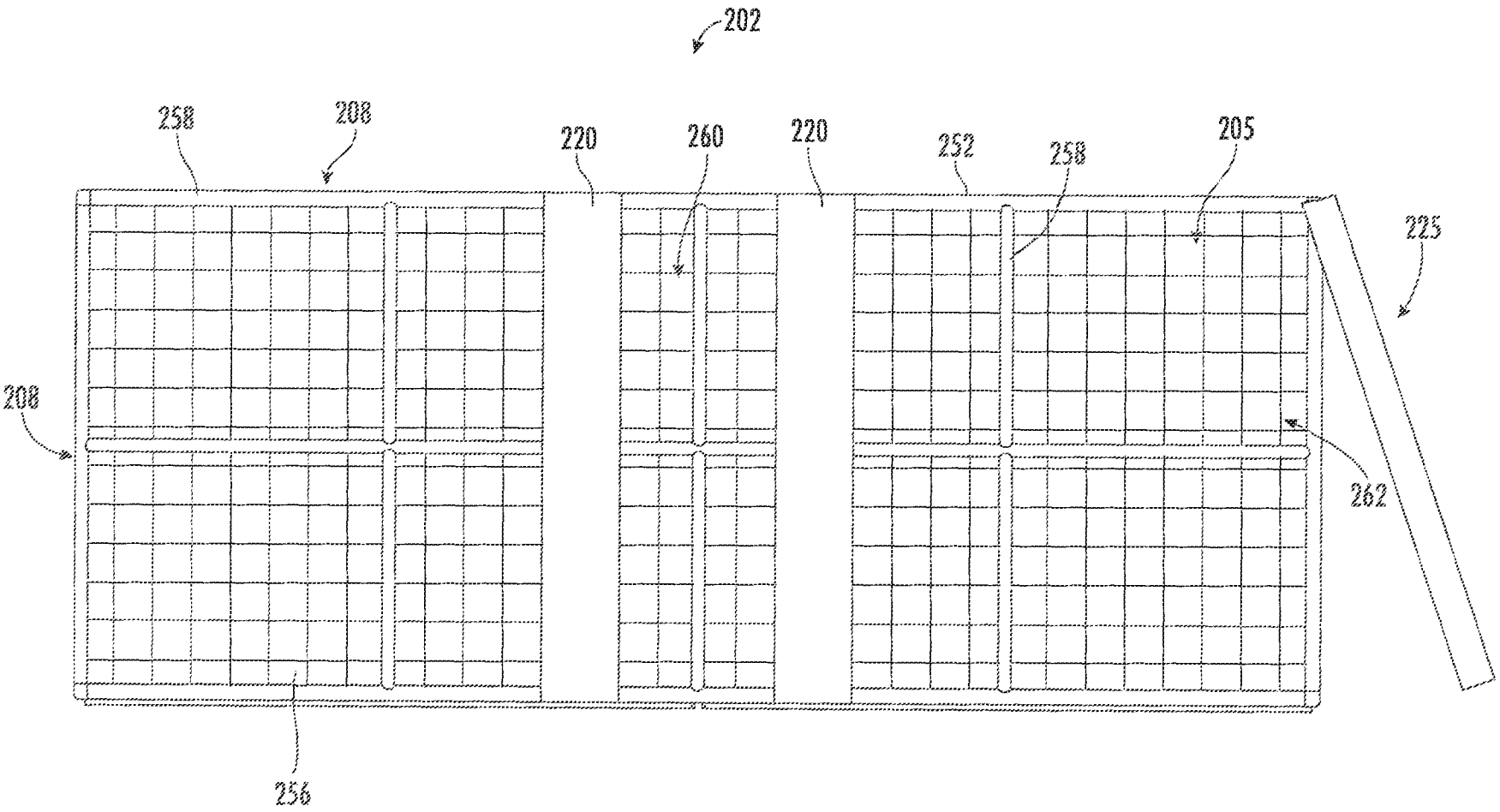
FIG. 7 is a bottom view of a razor wire container according to exemplary approaches of the disclosure.

Shown in FIG. 7, the floor 205 may further include a wire mesh fencing extending between the structural elements (e.g., similar to the floor shown in FIGS. 1-5 above). In some embodiments, the wire mesh fencing of the floor 205 may be coupled or welded to the structural elements of the floor perimeter 204 to provide a secure connection therebetween. The wire mesh fencing may be a woven wire mesh having a square pattern, which is supported by the structural elements. The wire mesh fencing is preferably formed from a strong and durable material, such as steel. The wire mesh fencing may be sized and arranged so as to substantially cover the area of the floor 205 defined by the outer perimeter.

As further shown in FIG. 7, extending along the second side 256 of the floor 205 is the pair of component receptacles 220 in the central area 260 thereof. Each of the component receptacles 220 may be a hollow member extending parallel to one another. In some embodiments, the component receptacles 220 may extend substantially between opposite side walls 208 to enable access by the forklift from either side. The component receptacles 220 are preferably formed from a strong and durable material, such as steel, and may be coupled to the structural elements 258 of the floor 205, for example, by bolts or via welding. Although not limited to any particular shape or configuration, the component receptacles 220 are preferably dimensioned so as to accept a fork of a forklift therein. During use, the component receptacles 220 allow the container 200 to be lifted off of the ground surface and moved by the forklift when access through the physical access point is desired.

Figure 8:
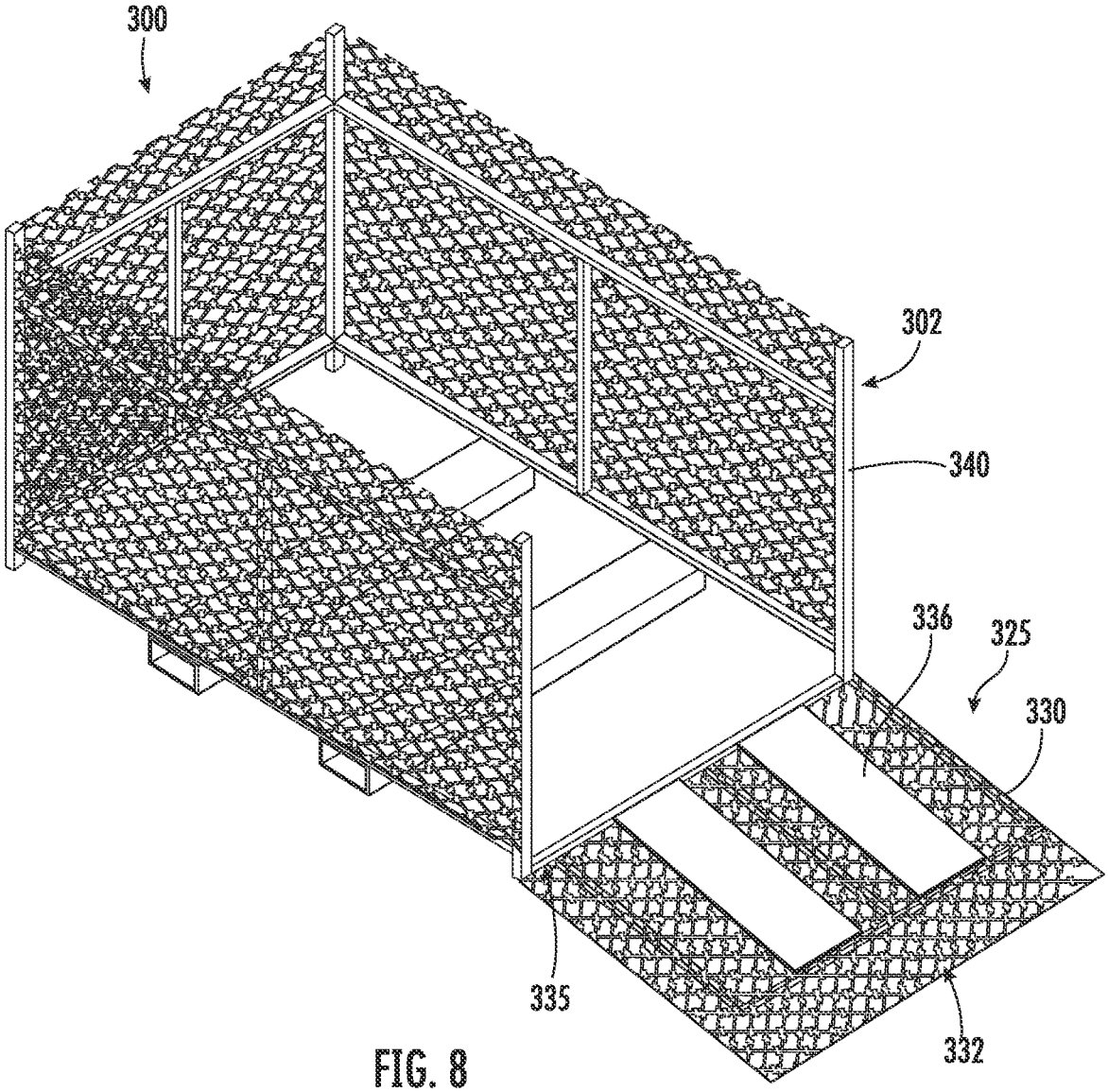
FIG. 8 is a perspective view of a razor wire container according to exemplary approaches of the disclosure.

FIG. 8 is a perspective view of a razor wire container 300 according to exemplary approaches of the disclosure. The container 300 may include any of the features previously described in relation to the barrier 100 and container 200 above and, as such, may not be described hereinafter in full detail for the sake of brevity. In this embodiment, the container 300 may include an access panel 325, which pivots about the frame 302 towards the ground. More specifically, the access panel may rotate about a lower frame element 335. The access panel 325 is shown in an open configuration. When in a closed configuration, the access panel 325 folds/pivots upwards, and may be secured to one or more vertical posts 340 of the frame 302. In exemplary embodiments, the access panel 325 may include a panel frame 330 coupled to a section of razor wire 332. The panel frame 330 may include one or more support ramps 336 extending along the access panel 325 to assist with loading and unloading of the contents of the container 300. For example, the support ramps 336 may be steel pieces coupled to the panel frame 330 and configured to support the weight of a vehicle or machine and to prevent damage to the razor wire 332.

Figure 9:
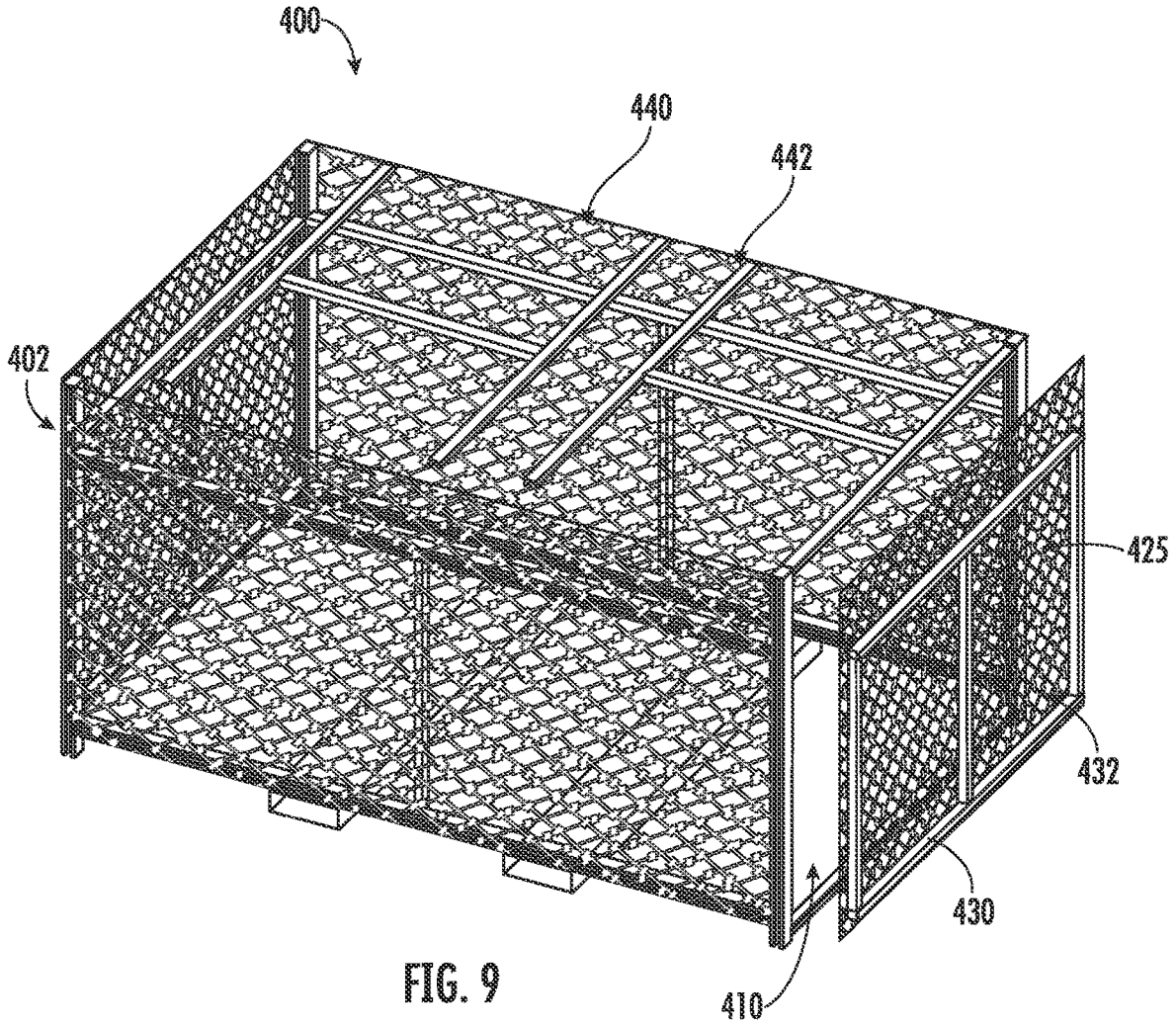
FIG. 9 is a perspective view of a razor wire container according to exemplary approaches of the disclosure.
Figure 10:
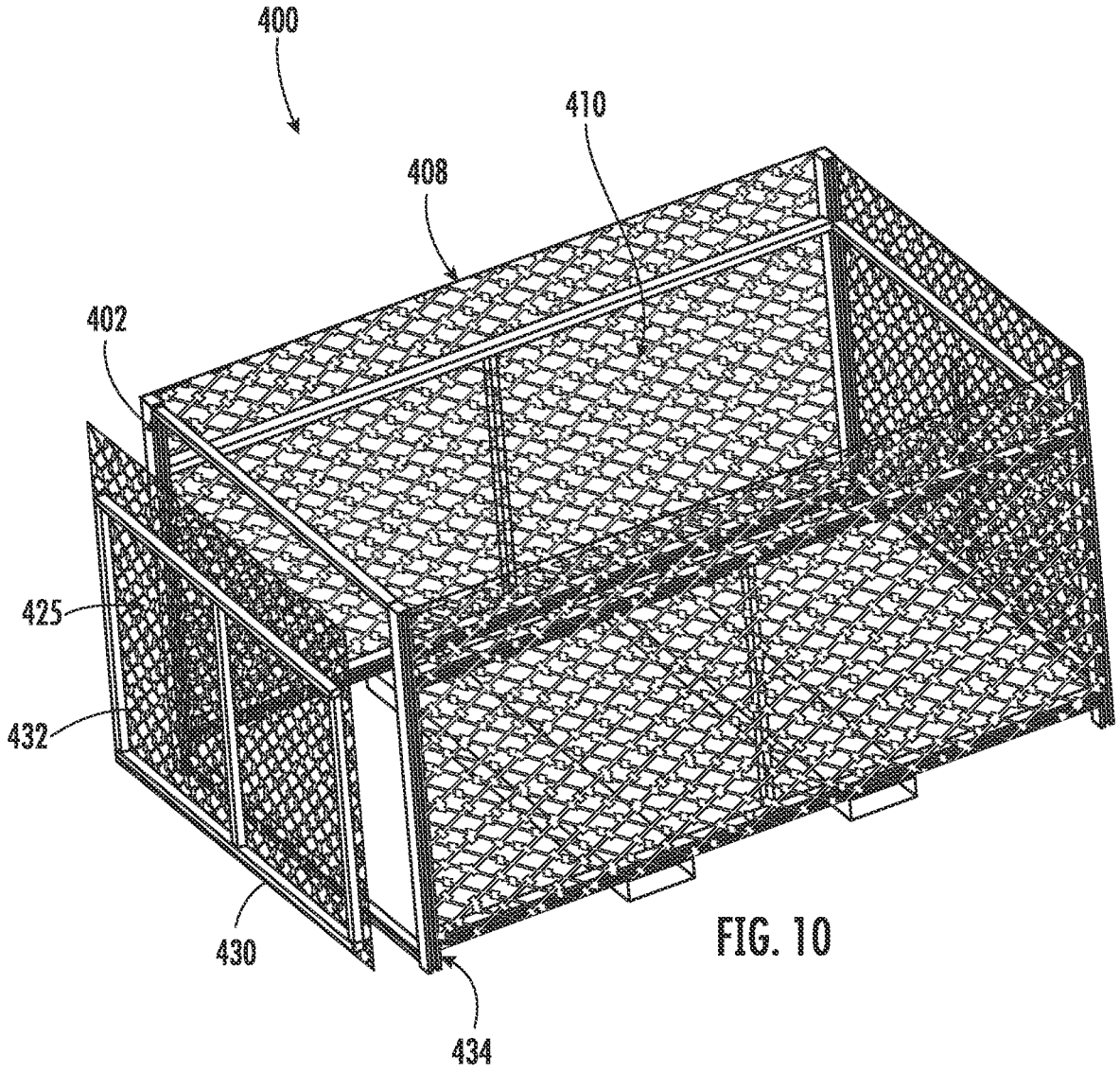
FIG. 10 is a perspective view of another razor wire container according to exemplary approaches of the disclosure.

FIGS. 9-10 are perspective views of another razor wire container 400 according to exemplary approaches of the disclosure. The container 400 may include any of the features previously described in relation to the barrier 100 and the containers 200, 300 above and, as such, may not be described hereinafter in full detail for the sake of brevity. In the embodiment of FIG. 9, the container 400 may include a closed top 440, which may be integrally formed with the frame 402. In the embodiment of FIG. 10, the top 440 may be removable or absent. For example, the top 440 may be lifted off, or rotated away, from the frame 402, to permit access to the interior 410. In some embodiments, the top 440 may include one or more structural elements 442, which provide support to the top 440 and provide for tool engagement. In exemplary embodiments, the top 440 includes one or more panels of razor wire. However, in other embodiments, the top 440 may be a wire mesh fencing and/or include barbed wire.

As shown, the container 400 may include one or more access components or panels 425. As shown, the access panel 425 may be one of the plurality of sidewalls 408, such as an end wall. The access panel 425 may be a door, which is removably coupled/decoupled with one or more members of the frame 402. In some embodiments, the access panel 425 slides vertically and/or horizontally with respect to an access opening frame 434, the access opening frame 434 defining a side opening of the container 400. In some embodiments, the access panel 425 may include a panel frame 430 coupled to a section of razor wire 432. The panel frame 430 may be coupled to the access opening frame 434.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other.

Furthermore, identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

Furthermore, the terms "substantial" or "substantially," as well as the terms "approximate" or "approximately," can be used interchangeably in some embodiments, and can be described using any relative measures acceptable by one of ordinary skill in the art. For example, these terms can serve as a comparison to a reference parameter, to indicate a deviation capable of providing the intended function. Although non-limiting, the deviation from the reference parameter can be, for example, in an amount of less than 1%, less than 3%, less than 5%, less than 10%, less than 15%, less than 20%, and so on.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, the present disclosure has been described herein in the context of a particular implementation in a particular environment for a particular purpose. Those of ordinary skill in the art will recognize the usefulness is not limited thereto and the present disclosure may be beneficially implemented in any number of environments for any number of purposes. Thus, the claims set forth below are to be construed in view of the full breadth and spirit of the present disclosure as described herein.

What is claimed is:

1. A razor wire barrier comprising:

a frame comprising:

a plurality of perimeter posts extending from a floor; and a cross post extending between two adjacent perimeter posts of the plurality of perimeter posts;

a plurality of razor wire panels coupled to the frame, wherein each of the plurality of razor wire panels extends vertically from the floor, and wherein the plurality of razor wire panels and the frame define a first main side opposite a second main side, and a first end opposite a second end;

a movable access component defining the first end, wherein the movable access component is rotatably coupled to one of the plurality of perimeter posts, and wherein the movable access component comprises:

a panel frame; and a razor wire panel coupled to an exterior surface of the panel frame, wherein the razor wire panel is a single, continuous panel extending entirely across the first end, between two adjacent perimeter posts, when the razor wire panel is in a closed configuration, wherein the plurality of razor wire panels coupled to the frame and the razor wire panel coupled to the panel frame define an interior area, and wherein each of the plurality of perimeter posts, the cross post, and the panel frame is positioned within the interior area; and a component receptacle extending along an outer side of the floor, wherein the component receptacle is operable to receive a component for moving the frame, and wherein the component receptacle extends entirely between a pair of opposing walls of the frame.

2. The razor wire barrier according to claim 1, wherein each of the plurality of perimeter posts extends substantially perpendicularly from the floor, and wherein the cross post is oriented substantially perpendicular to each of the plurality of perimeter posts.

3. The razor wire barrier according to claim 1, wherein the floor comprises a wire fencing.

4. The razor wire barrier according to claim 1, wherein the component receptacle includes a hollow member.

5. The razor wire barrier according to claim 4, further comprising a second hollow member proximate the hollow member, wherein the hollow member and the second hollow member are oriented parallel to one another, and wherein the second hollow member extends entirely between the pair of opposing walls of the frame.

6. A razor wire container, comprising:

a frame comprising:

a plurality of perimeter posts extending from a floor; and a cross post extending between two adjacent perimeter posts of the plurality of perimeter posts;

a plurality of razor wire panels coupled to the frame, wherein each of the plurality of razor wire panels extends vertically from the floor, wherein at least one of the plurality of razor wire panels is coupled to an exterior surface of the cross post and to an exterior surface of each of the two adjacent perimeter posts, and wherein the plurality of razor wire panels and the frame define a first main side opposite a second main side, and a first end opposite a second end;

a movable access component defining the first end, wherein the movable access component is rotatably coupled to one of the plurality of perimeter posts, and wherein the movable access component comprises:

a panel frame comprising a plurality of frame components; and a razor wire panel coupled to an exterior surface of each of the plurality of panel frame components, wherein the razor wire panel is a single, continuous panel extending entirely across the first end, between two adjacent perimeter posts, when the razor wire panel is in a closed configuration, wherein the plurality of razor wire panels coupled to the frame and the razor wire panel coupled to the panel frame define an interior area, and wherein each of the plurality of perimeter posts, the cross post, and the panel frame is positioned within the interior area; and a component receptacle extending along an outer side of the floor, wherein the component receptacle is operable to receive a component for moving the frame, and wherein the component receptacle extends entirely between a pair of opposing walls of the frame.

7. The razor wire container according to claim 6, wherein each of the plurality of perimeter posts extends substantially perpendicularly from the floor, and wherein the cross post is oriented substantially perpendicular to each of the plurality of perimeter posts.

8. The razor wire container according to claim 6, wherein the floor comprises a wire fencing.

9. The razor wire container according to claim 6, wherein the component receptacle includes a hollow member.

10. The razor wire container according to claim 9, further comprising a second hollow member proximate the hollow member, wherein the hollow member and the second hollow member are oriented parallel to one another, and wherein the first and second hollow members extend entirely between opposite facing walls of the frame.

* * * * *